US008555843B2

(12) United States Patent
Klousia et al.

(10) Patent No.: US 8,555,843 B2
(45) Date of Patent: Oct. 15, 2013

(54) CHARGE BYPASS SYSTEM FOR ENGINE START

(75) Inventors: Heidi K. Klousia, Asbury, IA (US); Christopher R. Benson, Dubuque, IA (US)

(73) Assignee: Deere & Company, Moline, IL (US)

( * ) Notice: Subject to any disclaimer, the term of this patent is extended or adjusted under 35 U.S.C. 154(b) by 332 days.

(21) Appl. No.: 13/034,107

(22) Filed: Feb. 24, 2011

(65) Prior Publication Data

US 2012/0220426 A1 Aug. 30, 2012

(51) Int. Cl.
*F01M 5/02* (2006.01)
*F02D 41/06* (2006.01)

(52) U.S. Cl.
USPC ..... 123/179.15; 123/196 R; 123/435; 123/436; 123/459; 123/464

(58) Field of Classification Search
USPC ..... 123/179.1, 179.12–179.17, 491, 435, 123/436, 196 R, 457, 458, 459, 464, 510, 123/511, 196 CP
See application file for complete search history.

(56) References Cited

U.S. PATENT DOCUMENTS 5,339,776 A * 8/1994 Regueiro ..... 123/196 CP
6,626,141 B2 * 9/2003 Choi ..... 123/196 R

* cited by examiner

*Primary Examiner* — Hai Huynh
(74) *Attorney, Agent, or Firm* — Stephen F. Rost; Taft Stettinius & Hollister. LLP

(57) ABSTRACT

The present invention provides an engine start system in a vehicle. The engine start system includes an engine and a charge system. The vehicle also includes an engine speed sensor for measuring a speed of the engine. The charge system is coupled to the engine and includes a charge pump. The vehicle further includes a control unit and a temperature sensor for sensing a temperature of fluid in the charge system. The temperature sensor is electrically coupled to the control unit. A bypass system is fluidly coupled to the charge system and includes a valve and a solenoid. The solenoid is electrically coupled to the control unit such that the control unit energizes the solenoid to control the valve in response to the speed measured by the speed sensor and the temperature sensed by the temperature sensor.

20 Claims, 2 Drawing Sheets

CHARGE BYPASS SYSTEM FOR ENGINE START

FIELD OF THE INVENTION

The present invention relates to a mechanism for initiating the start of an engine, and in particular to a bypass system for improving a cold engine start.

BACKGROUND OF THE INVENTION

In cold temperatures, conventional engines can have difficulty starting. There are several reasons for this depending on the type of engine. For example, for an engine that operates off a battery, batteries often have trouble during cold temperatures. Batteries include chemicals inside thereof that produce electrons, and chemical reactions inside the battery can take place slower in cold temperatures and thus produce less electrons. As a result, the starter motor has less energy when trying to start the cold engine, and therefore the engine cranks much slower when it is colder.

Another reason for difficulty starting an engine during cold temperatures is the viscosity of the oil inside the starting system. Oil viscosity increases in cold temperatures and thus makes it more difficult to crank an engine.

In a conventional crawler loader, for example, pressure inside the crawler's engine starting system is built up by a charging pump. The loader can include an engine for producing power to drive the machine, and during an engine start the engine rotates a shaft coupled to the charging pump. During normal operation, the oil inside the pump has a viscosity which allows the pump to rotate and build up pressure. However, during cold temperatures, the oil inside the charging pump increases in viscosity and resists being moved by the shaft. This resistance causes a parasitic load to be placed on the engine and increases the difficulty of starting the engine. In other words, if the engine is unable to crank due to the parasitic load, the engine either will not start or may have difficulty starting.

A need therefore exists to provide an improved way of starting an engine during cold temperatures. In particular, there is a need for reducing the parasitic load when starting an engine in cold temperatures.

SUMMARY

In one exemplary embodiment of the present disclosure, an engine start system in a vehicle is provided that includes an engine and a charge system. The vehicle also includes an engine speed sensor for measuring a speed of the engine. The charge system is coupled to the engine and includes a charge pump. The vehicle further includes a control unit and a temperature sensor for sensing a temperature of fluid in the charge system. The temperature sensor is electrically coupled to the control unit. A bypass system is fluidly coupled to the charge system and includes a valve and a solenoid. The solenoid is electrically coupled to the control unit such that the control unit energizes the solenoid to control the valve in response to the speed measured by the speed sensor and the temperature sensed by the temperature sensor.

In one aspect of this disclosure, the charge system can include a first and a second charge pump. In a different aspect, the vehicle can further include a transmission system which includes a reservoir fluidly coupled to the bypass system. In another aspect, a relief valve can be fluidly coupled to the charge pump and a filter can be fluidly coupled between the charge pump and the relief valve.

In a different aspect, the engine start system can include a first fluid path, a second fluid path, and a third fluid path. The first fluid path is defined between the charge pump and the inlet of the bypass system. The second fluid path is defined between the inlet of the bypass system and the relief valve. The third fluid path is defined between the inlet of the bypass system and the reservoir. When the valve of the bypass system is in its closed position, the first fluid path is fluidly coupled to the second fluid path. Alternatively, when the valve is in its open position, the first fluid path is fluidly coupled the third fluid path.

In one form of this embodiment, the bypass system can include an inlet, a first outlet, and a second outlet. The first inlet can be fluidly coupled to the charge pump, the first outlet can be fluidly coupled to the relief valve, and the second outlet can be fluidly coupled to the reservoir. In another form thereof, the valve comprises an open position and a closed position. The inlet is fluidly coupled to the second outlet when the valve is in the open position and the inlet is fluidly coupled to the first outlet when the valve is in the closed position.

In a different embodiment, a method is provided for reducing a parasitic load on an engine in a vehicle during a cold start. The method includes measuring a speed of the engine. A temperature of a fluid flowing through a charge system of the vehicle is measured and a determination is made whether the measured speed is below a first threshold and the measured temperature is below a second threshold. The method also includes diverting at a least a portion of the fluid flow through a bypass system to a reservoir and reducing the parasitic load on the engine.

In one form of this embodiment, the method includes energizing a solenoid to open a bypass valve. In another form thereof, the method includes diverting at least a portion of the fluid flow when the temperature is at or below 0° C. The method can also include diverting at least a portion of the fluid flow when the measured engine speed is at or below 300 RPM. The parasitic load can be reduced by reducing the charge pressure.

In another embodiment, a method is provided for reducing a parasitic load on an engine through an engine start system. The engine start system includes a charge pump, a charge relief valve, and a bypass system. The bypass system includes an inlet, a first outlet, a second outlet, a solenoid, and a bypass valve. The method includes (a) measuring a speed of the engine; (b) measuring a temperature of a fluid in the engine start system with a sensor; (c) pressurizing the engine start system; (d) directing the fluid from the charge pump to the charge relief valve through the first outlet of the bypass system; (e) diverting a portion of the fluid through the second outlet; and (f) reducing the parasitic load on the engine.

In one aspect, the method performs steps (d)-(f) if the measured engine speed is below a first threshold and the measured temperature is below a second threshold. In a different aspect, the method skips steps (e) and (f) if the measured engine speed is at or above a first threshold or the measured temperature is at or above a second threshold. The method can further include energizing the solenoid if the measured speed is below a first threshold and the measured temperature is below a second threshold.

In another aspect, the method includes closing the second outlet of the bypass system once the measured engine speed is greater than a threshold. The method can also include reducing the pressure in the engine start system to less than the relief pressure. In an alternative aspect, the method includes receiving a signal from a control unit, energizing the solenoid of the bypass system, moving the bypass valve from a closed position to at least a partially open position, and forming a flow path from the inlet of the bypass system to the second outlet.

In the present disclosure, the bypass system provides a means for reducing the parasitic load on the engine. This is particularly true when fluid temperatures are at or below a threshold temperature and the engine has not yet started. Although the fluid viscosity is higher than during normal operation, the pressure in the charge system can be reduced by the bypass system and therefore reduce the parasitic load. This makes it easier to start the engine in colder temperatures.

Another advantage is once the engine is started, the bypass system can be deactivated so that the charge system returns to normal operation. In other words, the bypass system can be activated to assist with engine start in cold temperatures, but once the engine starts, the bypass system can be deactivated. This enhanced controllability function of the bypass system overcomes many limitations in conventional engine start systems.

BRIEF DESCRIPTION OF THE DRAWINGS

The above-mentioned aspects of the present invention and the manner of obtaining them will become more apparent and the invention itself will be better understood by reference to the following description of the embodiments of the invention, taken in conjunction with the accompanying drawings, wherein.

Corresponding reference numerals are used to indicate corresponding parts throughout the several views.

DETAILED DESCRIPTION

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

In the present disclosure, a means for diverting fluid flow is incorporated into a system to reduce a parasitic load during an engine start in cold temperatures. For purposes of this disclosure, a cold temperature refers to the temperature of oil in an engine or transmission system of a vehicle. The oil temperature is first measured, and based on the measurement, the system can either perform under normal conditions or activate a bypass system to reduce the parasitic load. An example of this is illustrated in FIG. 1.

Figure 1:
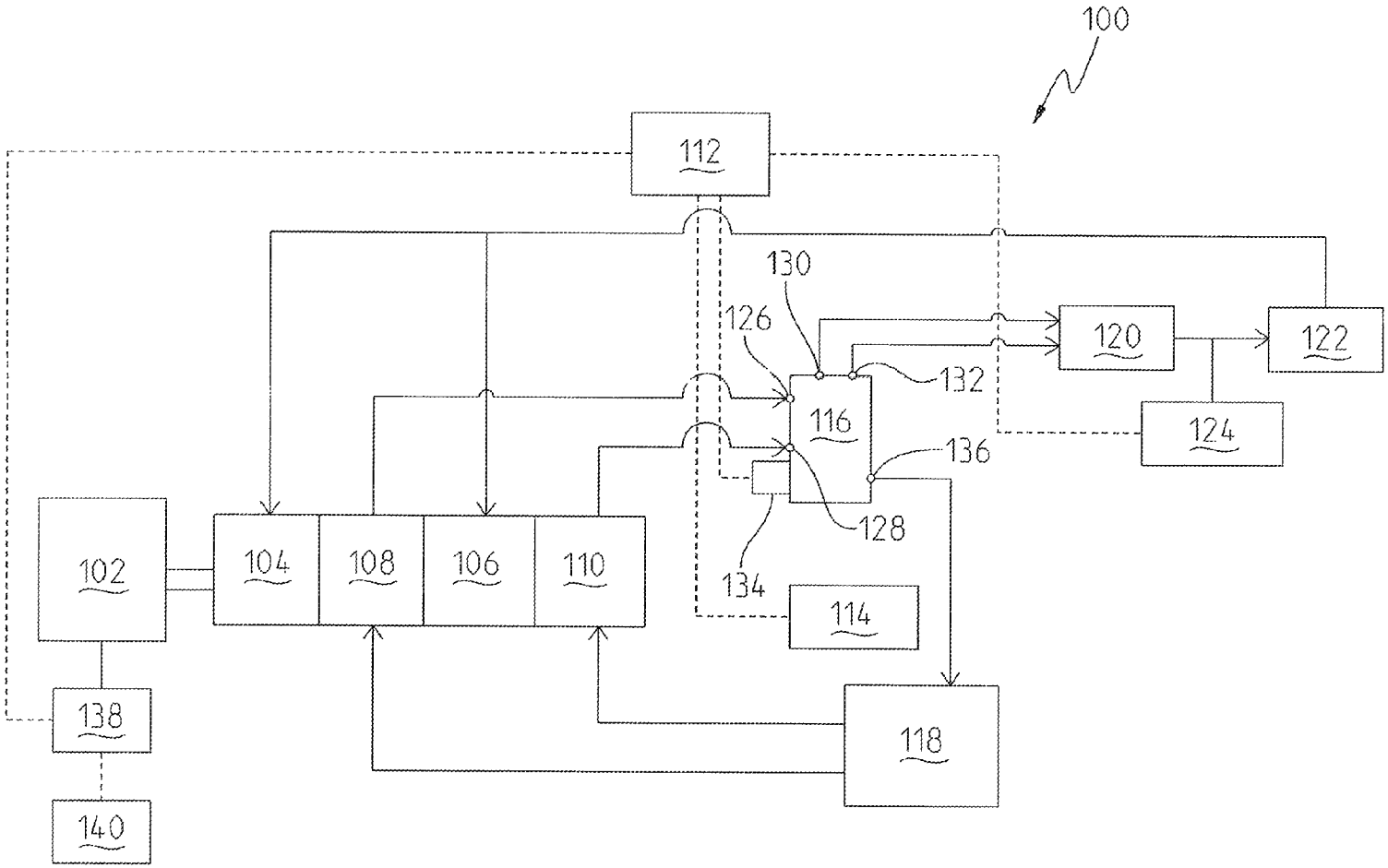
FIG. 1 is a schematic of a charging system for engine startup.

An exemplary embodiment of an engine start system 100 of a vehicle is shown in FIG. 1. The engine start system 100 includes an engine 102 for generating power to the vehicle. The engine 102 can be any known engine such as a diesel or hydraulic engine. The engine 102 provides power to drive a first hydrostatic pump 104 and a second hydrostatic pump 106. The first hydrostatic pump 104 and second hydrostatic pump 106 are part of the vehicle's hydrostatic transmission system. The first hydrostatic pump 104 drives a first hydrostatic motor (not shown) and the second hydrostatic pump 106 drives a second hydrostatic motor (not shown). The motors are also part of the hydrostatic transmission system and form, along with the first and second hydrostatic pumps, a closed loop flow circuit through which oil flows. A sensor 114 can measure the temperature of the oil flowing through the hydrostatic transmission system and transmit the measurement to a vehicle control unit 112.

The system 100 also includes a first charge pump 108 and a second charge pump 110. The first and second charge pumps are coupled to the engine 102 and form part of the transmission system. As the engine 102 begins to crank during a start, it rotates a pump shaft (not shown) which in turn rotates the first charge pump 108 and second charge pump 110. As both charge pumps rotate, each pump builds a charge pressure and fluid flow through the system 100. The charge pressure in the system 100 can be measured by a charge pressure sensor 124. As shown in FIG. 1, the charge pressure sensor 124 can communicate with the vehicle control unit 112. The pressure sensor can be any known sensor such as a Sensata 3PP8 Series pressure sensor.

A relief valve 122 is fluidly coupled to the first charge pump 108 and second charge pump 110. As pressure builds in the system 100, oil flows from the first and second charge pumps through a filter 120 to the relief valve 122. The relief valve 122 has a pressure threshold. Until the charge pressure exceeds the threshold, the relief valve 122 is closed. However, once the charge pressure exceeds the threshold, the relief valve 122 is opened and the oil can flow through the valve.

In a non-limiting example, the relief valve 122 can have a pressure setting or threshold of 320 psi. The relief valve 122 can include a spring (not shown) which has a spring force. To open the relief valve 122 and allow fluid flow therethrough, the charge pressure must overcome the pressure differential created by the spring force of the relief valve 122 and oil pressure on the opposite side of the valve 122.

As the first charge pump 108 and second charge pump 110 continue to build charge pressure in the system 100, the increase in charge pressures creates a parasitic load on the engine 102. During normal operation, the parasitic load can be easily overcome and the engine performs routinely. However, when the oil in the system 100 has an increased viscosity, the parasitic load on the engine is greater and the engine may not be able to overcome this load. The oil viscosity is greater at lower temperatures, so the engine can have difficulty starting due to the increased parasitic load. In particular, the pressure differential at the relief valve 122 is much greater at lower oil temperatures and it becomes more difficult to open the valve and relieve the increased charge pressure in the system 100.

Figure 2:
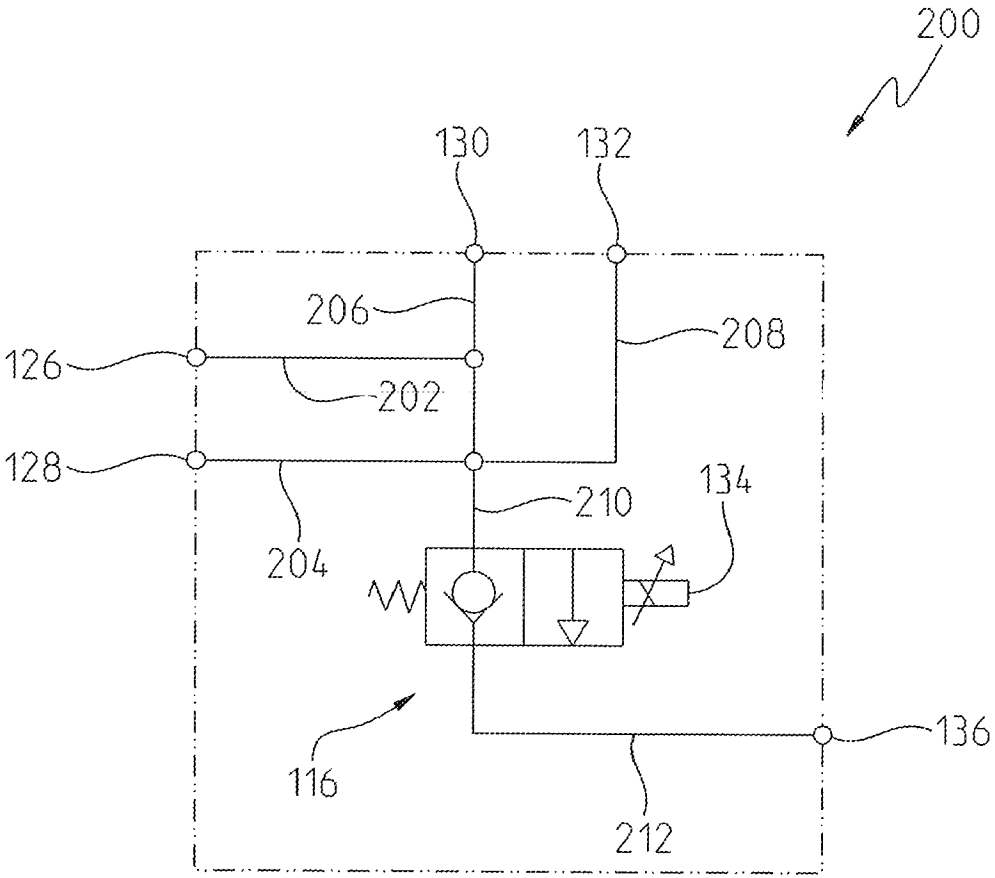
FIG. 2 is a schematic of a bypass system for a cold engine start.

To reduce the parasitic load, i.e., reduce the charge pressure, the system 100 can include a bypass system. Referring to FIGS. 1 and 2, an exemplary bypass system 200 includes a bypass valve 116 and a solenoid 134. In one embodiment, the bypass valve 116 can be any known pressure bypass valve. For example, the bypass valve 116 can be a SP16-20, 2-way, normally closed proportional valve supplied by HydraForce, Inc. The bypass valve 116 can be electrically-controlled by the solenoid 134. As shown in FIG. 1, the solenoid 134 can be electrically coupled to the vehicle control unit 112. Thus, the vehicle control unit 112 can send a signal to energize the solenoid which causes the bypass valve 116 to open. Similarly, the vehicle control unit 112 can de-energize the solenoid 134 to close the valve 116.

The bypass system 200 includes at least one inlet and at least two outlets. In the illustrated embodiments of FIGS. 1 and 2, the bypass system 200 has a first inlet 126 and a second inlet 128. The first charge pump 108 is fluidly coupled to the first inlet 126 and the second charge pump 110 is fluidly coupled to the second inlet 128. Thus, as the charge pumps are rotated by the engine 102, the flow of oil passes through the first and second inlets of the bypass system 200.

The illustrated bypass system 200 also includes a first outlet 130, a second outlet 132, and a bypass outlet 136. The first outlet 130 and second outlet 132 are fluidly coupled to the filter 120 and relief valve 122. The charge pressure passing through the first outlet 130 and second outlet 132 is therefore being measured by the charge pressure sensor 124. The bypass valve 136, on the other hand, is fluidly coupled to a reservoir 118. The reservoir 118 can be a tank or sump that is part of the transmission system. As shown, oil that flows into the reservoir 118 can then flow back through the first charge pump 108 and second charge 110.

The operation of the bypass system 200 is further illustrated in FIG. 2. In the non-limiting example described above, the relief valve 122 has a pressure setting or threshold of 320 psi. Again, this value is not intended to be limiting and is only provided as an example for further illustrating the advantages of the present disclosure. The pressure setting or threshold of 320 psi is, however, for normal operation. When the oil temperature is much lower, and the viscosity therefore is greater, the charge pressure may have to exceed 500 psi before the relief valve 122 opens. This creates the parasitic load on the engine 102 during a cold start that makes it difficult to start the engine 102.

To reduce the charge pressure during a cold start, the bypass valve 116 can be at least partially opened to allow oil or other fluid to pass through the bypass outlet 136. In one aspect, the bypass valve 116 can either be fully open or fully closed. In a different aspect, the valve 116 can be incrementally opened depending on the signal sent from the vehicle control unit 112. Therefore, as oil passes through the first inlet 126 of the bypass system, the oil flows through a first flow path 202 (or channel). Similarly, the oil passing through the second inlet 128 passes through a second flow path 204 (or channel). During normal operation, i.e., when the bypass valve 116 is closed, oil passing through the first flow path 202 is directed through the first outlet 130 via a third flow path 206. The first flow path 202 and third flow path 206 are fluidly coupled to one another. Similarly, when the bypass valve 116 is closed, oil passing through the second flow path 204 is directed through the second outlet 132 via a fourth flow path 208. The second flow path 204 and fourth flow path 208 are fluidly coupled to one another.

When the bypass valve 116 is opened, however, another flow path 210 is formed in the bypass system 200. Oil can still pass through the first outlet 130 and second outlet 132, but at least a portion of the oil can pass through a fifth flow 210. The fifth flow path 210 is in fluid communication with the inlet of the bypass valve 116 and a sixth flow path 212 is in fluid communication with the outlet of the bypass valve 116. The fifth flow path 210 and sixth flow path 212 are fluidly coupled when the bypass valve 116 is opened such that oil can be diverted through the bypass valve 116 and into the reservoir 118. The diversion of oil through the bypass valve 116 reduces the charge pressure being measured by the charge pressure sensor 124. More importantly, the fluid pressure at the relief valve 122 is reduced and thus reduces the parasitic load on the engine 102.

In one embodiment, the engine 102 can be started by any known method, e.g., turning a key or pressing a button. The temperature sensor 114 communicates with the vehicle control unit 112 by transmitting the temperature of oil in the transmission system. Depending on the temperature of the oil, the vehicle control unit 112 can control the bypass valve 116. In one aspect, the vehicle control unit 112 opens the bypass valve 116 if the temperature is below a threshold. This threshold can be 0° C., for example. Alternatively, the threshold can be 10° C., −10° C., or any temperature therebetween. This may also depend on the type of engine. Most conventional engines have difficulty starting in cold temperature due to factors related to the particular engine. However, the additional parasitic load added to the engine by the charge pumps further inhibits the engine's ability to start, particularly in colder temperature.

Therefore, during a cold engine start, the temperature sensor 114 measures the oil temperature in the hydrostatic transmission system and communicates that measurement with the vehicle control unit 112. Before the engine is started, the vehicle control unit 112 can open the bypass valve 116 if the oil temperature is below the threshold. Referring to the embodiment of FIG. 1, the vehicle control unit 112 can communicate with the engine 102, and in particular with an engine controller 138 to determine if the engine 102 has started. The engine controller 138 can receive engine speed data from an engine speed sensor 140 disposed near or on the crankshaft of the engine 102. In one aspect, the vehicle control unit 112 can determine that the engine 102 has not started if the engine speed is below 300 RPM. In another aspect, the vehicle control unit 112 can determine the engine has not started if the engine speed is below 700 RPM. The engine speed threshold (e.g., 300 RPM) can be different depending on the type of engine and controller being used. Therefore, before the engine starts, the vehicle control unit 112 is in communication with the engine controller 138 and temperature sensor 114 to determine whether the bypass valve 116 should be opened or closed.

As the engine 102 begins to crank, pressure in the system 100 increases as the first charge pump 108 and second charge pump 110 are rotationally driven by the engine 102. Oil is forced through the system 100 and enters the bypass system 200 through the first inlet 126 and second 128. If the temperature measurement falls below the temperature threshold (and the engine speed sensor 140 communicates an engine speed less than an engine speed threshold), the vehicle control unit 112 sends a signal to and energizes the solenoid 134. By energizing the solenoid 134, the bypass valve 116 at least partially opens so that oil flowing through the first inlet 126 and second inlet 128 is partially diverted through the bypass valve 116 and bypass outlet 136. The remaining flow of oil passes through the first outlet 130 and second outlet 132. As the oil is diverted, charge pressure measured by the charge pressure sensor 124 is reduced and thus the parasitic load imposed on the engine 102 is reduced.

As the engine 102 is started, the engine speed sensor 140 continuously measures the engine speed and communicates the same to the engine controller 138. The engine controller 138 transmits the engine speed measurements to the vehicle control unit 112. Once the engine speed overcomes a second engine speed threshold, the vehicle control unit 112 can de-energize the solenoid 134 and close the bypass valve 116. In one aspect, the second engine speed threshold can be the same as the first engine speed threshold (e.g., before the engine starts). Alternatively, the first engine speed threshold can be a lower value than the second engine speed threshold. For instance, the second engine speed threshold can be between 600-800 RPM depending on the type of engine, whereas the first engine speed threshold can be between 250-350 RPM. Once the solenoid 134 is de-energized, the bypass valve 116 closes and flow is no longer diverted through the bypass outlet 136. In this embodiment, the oil temperature is used only for opening the bypass valve 116. However, in alternative embodiments, the engine speed and oil temperature can be used for determining whether to open and close the bypass valve 116.

Test results using the engine start system 100 described above further highlight the advantages of the bypass system. In a first test, the charge pressure was measured by the charge pressure sensor 124 with the bypass system 200 being removed from the overall system 100. In this example, during a cold start in which the oil temperature measured by the temperature sensor 114 was less than 0° C., the charge pressure began to level out at about 500 psi.

In a second test, the bypass system 200 was added to the system 100 as shown in FIG. 1. Again, the oil temperature measured less than 0° C. during engine start, but during the cold start the bypass valve 116 opened and the charge pressure was reduced to 160 psi.

A similar test produced results indicating that the parasitic load on the engine 102 is reduced by approximately 68% when the oil temperature measures at about −20° C. and the bypass valve 116 opens to divert flow to the reservoir 118.

In another engine start system, the relief valve 122 can have a lower pressure setting. For instance, the relief valve 122 can include a spring having a lower spring force. Therefore, as charge pressure builds in the system 100, the relief valve 122 can open at a lower pressure to thereby reduce the charge pressure being measured by the charge pressure sensor 124. For example, the pressure setting can be 140 psi rather than 320 psi.

In another alternative engine start system, the vehicle control unit 112 can be used to adjust the pressure setting on the relief valve 122. In this particular embodiment, the vehicle control unit 112 can either adjust the pressure setting on the relief valve 122 to reduce charge pressure or divert flow through the bypass system 200 as described above. In other instances, the vehicle control unit 112 can reduce the pressure setting on the relief valve 122 and energize the solenoid 134 to divert flow. These alternative embodiments provide additional ways to reduce the parasitic load on the engine during a cold start.

While exemplary embodiments incorporating the principles of the present invention have been disclosed hereinabove, the present invention is not limited to the disclosed embodiments. Instead, this application is intended to cover any variations, uses, or adaptations of the invention using its general principles. Further, this application is intended to cover such departures from the present disclosure as come within known or customary practice in the art to which this invention pertains and which fall within the limits of the appended claims.

The invention claimed is:

1. An engine start system in a vehicle, comprising:

an engine and an engine speed sensor for measuring a speed of the engine;

a charge system coupled to the engine, the charge system including a charge pump;

a control unit and a temperature sensor for sensing a temperature of fluid in the charge system, the sensor being electrically coupled to the control unit; and a bypass system fluidly coupled to the charge system, the bypass system comprising a valve and a solenoid electrically coupled to the control unit;

a pressure relief valve fluidly coupled to the bypass system, where the bypass system includes an inlet side for receiving fluid from the charge pump and an outlet side fluidly coupled to the pressure relief valve;

wherein, the control unit energizes the solenoid to control fluid flow through the bypass system in response to the speed measured by the speed sensor and the temperature sensed by the temperature sensor.

2. The system of claim 1, wherein the charge system comprises a first charge pump and a second charge pump.

3. The system of claim 1, further comprising a transmission system, the transmission system including a reservoir fluidly coupled to the bypass system.

4. The system of claim 3, the relief valve is fluidly coupled to a first and second hydrostatic pump.

5. The system of claim 4, further comprising a filter fluidly coupled between the charge pump and the relief valve.

6. The system of claim 4, wherein the bypass system comprises an inlet, a first outlet, and a second outlet, the inlet being fluidly coupled to the charge pump, the first outlet fluidly coupled to the relief valve, and the second outlet fluidly coupled to the reservoir.

7. The system of claim 6, wherein the valve comprises an open position and a closed position, the inlet being fluidly coupled to the second outlet when the valve is in the open position and the inlet being fluidly coupled to the first outlet when the valve is in the closed position.

8. The system of claim 1, further comprising:

a first fluid path defined between the charge pump and an inlet of the bypass system;

a second fluid path defined between the inlet of the bypass system and the relief valve; and a third fluid path defined between the inlet of the bypass system and the reservoir;

wherein, the first fluid path is fluidly coupled to the second fluid path when the valve is in a closed position;

further wherein, the first fluid path is fluidly coupled to the third fluid path when the valve is in an open position.

9. A method for reducing a parasitic load on an engine in a vehicle during a cold start, comprising:

providing a temperature sensor, a charge pump having an outlet, a bypass system having at least one inlet and two outlets, a reservoir fluidly coupled to the charge pump, and a pressure relief valve coupled to one of the two outlets of the bypass system;

measuring a speed of the engine;

measuring a temperature of a fluid flowing through a charge system;

determining if the measured speed is below a first threshold and the measured temperature is below a second threshold;

diverting at least a portion of the fluid through a bypass system; and reducing the parasitic load on the engine.

10. The method of claim 9, further comprising energizing a solenoid to open a valve in the bypass system.

11. The method of claim 9, further comprising diverting at a least a portion of the fluid flow when the measured temperature is at or below 0° C.

12. The method of claim 9, further comprising diverting at a least a portion of the fluid flow when the measured engine speed is at or below 300 RPM.

13. The method of claim 9, further comprising reducing a charge pressure in the charge system.

14. A method of reducing a parasitic load on an engine through an engine start system, the engine start system including a charge pump, a charge relief valve, and a bypass system, the bypass system including an inlet, a first outlet, a second outlet, a solenoid, and a bypass valve, the method comprising:

(a) measuring a speed of the engine;

(b) measuring a temperature of a fluid in the engine start system with a sensor;

(c) pressurizing the engine start system;

(d) directing the fluid from the charge pump to the charge relief valve through the first outlet of the bypass system;

(e) diverting a portion of the fluid through the second outlet; and (f) reducing the parasitic load on the engine.

15. The method of claim 14, further comprising performing steps (d)-(f) if the measured engine speed is below a first threshold and the measured temperature is below a second threshold.

16. The method of claim 14, further comprising skipping steps (e) and (f) if the measured engine speed is at or above a first threshold or the measured temperature is at or above a second threshold.

17. The method of claim 14, further comprising energizing the solenoid if the measured speed is below a first threshold and the measured temperature is below a second threshold.

18. The method of claim 14, further comprising closing the second outlet of the bypass system once the measured engine speed is greater than a threshold.

19. The method of claim 18, further comprising reducing the pressure in the engine start system to less than a relief pressure.

20. The method of claim 14, further comprising:

receiving a signal from a vehicle control unit;

energizing the solenoid of the bypass system;

moving the bypass valve from a closed position to at least a partially open position; and forming a flow path from the inlet of the bypass system to the second outlet.

* * * * *